United States Patent [19]

Cina et al.

[11] 4,137,675

[45] Feb. 6, 1979

[54] SAND RECLAIMER

[75] Inventors: Ronald A. Cina; Albert D. Kluge, both of Lansing, Mich.

[73] Assignee: Roberts Corporation, Lansing, Mich.

[21] Appl. No.: 853,415

[22] Filed: Nov. 21, 1977

[51] Int. Cl.[2] ..... B24B 31/02

[52] U.S. Cl. ..... 51/164 R; 209/291; 209/270

[58] Field of Search ..... 209/291, 270; 51/164; 99/522

[56] References Cited

U.S. PATENT DOCUMENTS

| | | | |
|---|---|---|---|
| 1,889,989 | 12/1932 | Hughes | 209/291 |
| 1,897,156 | 2/1933 | Wells | 209/270 |
| 1,966,312 | 7/1934 | Rafetto | 209/291 |
| 2,286,132 | 6/1942 | Walle | 209/270 |
| 2,359,944 | 10/1944 | Schummer | 51/164 |

*Primary Examiner*—Harold D. Whitehead

*Attorney, Agent, or Firm*—Miller, Morriss and Pappas

[57] ABSTRACT

A cylindrical sand reclaimer drum for removing spent bonding contaminants and refuse from chemically bonded foundry molding sand and the like. The cylindrical drum is rotatably mounted along its longitudinal axis and is supported in a substantially horizontal inclined position along its longitudinal axis. The cylindrical drum has an intake opening at the elevated end thereof to receive the contaminated sand and process it through a plurality of internal compartments containing spherical or cube shaped abrasion media. The compartments are formed by a plurality of spaced-apart circular divider panels mounted on the central spindle or shaft of the cylindrical drum and which are perpendicular to the longitudinal axis thereof and are axially adjustable therealong. A plurality of spaced-apart openings are provided along the circumferential edge of each of the divider panels. Each opening is provided with a selectively adjustable gate so that the size of the opening can be adjusted as desired so that the size of the openings in each succeeding divider panel is smaller than those in the preceding divider panel. Thus, each divider panel removes refuse of a particular size from the sand as it passes therethrough. The lowermost final compartment has screen panels provided in the circumferential wall thereof which form the discharge opening for the clean reclaimed sand. The lower end wall of the cylindrical drum is provided with discharge openings through which the contaminants and refuse are discarded. Each compartment is provided with an access panel in the wall of the cylindrical drum so that spherical or cube shaped abrasion media can be selectively added or removed therefrom. Motor drive means are provided in association with the cylindrical sand reclaimer drum so as to rotate the drum so as to cause the contaminated sand to advance therethrough. Cyclone air removal suction means are provided in association with the sand reclaimer drum which are adapted to remove free bonding materials such as porous burnt resin particles which have been abraded from the sand during passage of the contaminated sand mass through the rotary sand reclaimer.

5 Claims, 5 Drawing Figures

SAND RECLAIMER

SUMMARY OF THE INVENTION

This invention relates to sand reclaimer drum which comprises a rotatable cylindrical drum for removing spent bonding contaminants and refuse from chemically bonded foundry molding sand and the like. The sand reclaimer drum is rotatably mounted along its longitudinal axis and is supported in a substantially horizontal inclined position along its longitudinal axis. An intake opening is provided at the elevated end of the sand reclaimer drum which is adapted to receive the contaminated sand and process it through a plurality of compartments some or all of which selectively contain spherical or cube shaped abrasion media. The internal compartments are formed by a series of spaced-apart circular divider panels mounted on the central shaft provided through the interior of the sand reclaimer drum and which are perpendicular to the longitudinal axis thereof and which can be axially adjustable therealong in order to selectively vary the size of the various compartments. Each of the divider panels is provided with a plurality of openings along the circumferential edges thereof. Selectively adjustable gates are provided in association with each opening so that the size of each opening can be adjusted in accordance with each specific use application. The selectively adjustable gates further permit the adjustment of the size of the openings so that the relative size of the openings in each divider panel are smaller than the openings in the preceding divider panel. Thus, the openings in the divider panel immediately adjacent the intake opening at the elevated end of the sand reclaimer drum are the largest in size and the openings in each succeeding divider panel decrease correspondingly in size.

The last or lowermost compartment is provided with screen panels in the circumferential walls thereof through which the cleaned reclaimed sand is discharged for re-use as desired.

Discharge openings are provided in the lower end wall of the sand reclaimer drum for contaminants and refuse which are of an oversized nature.

Access panels are provided in the wall of the sand reclaimer drum so that the spherical or cube shaped abrasion media can be selectively removed or added from each compartment as the need arises. Motor drive means are provided in association with the cylindrical sand reclaimer drum so as to selectively rotate the drum at a rate sufficient to advance the contaminated sand therethrough. Cyclone air removal suction means are provided in association with the sand reclaimer drum which is adapted to cause air flow upwardly through the screen panels and open ends of the rotary drum so as to remove free bonding materials such as porous burnt resin particles which have been abraded from the sand during the passage of the contaminated sand mass through the sand reclaimer drum.

The tumbling action imparted to the contaminated sand mass within the drum and the passage of sand mass from one compartment to another through the gated openings of progressively diminishing size also cause the individual sand particles to abrade against each other and against the spherical or cube shaped media and the walls of the drum so as to remove the burned bonding agents such as resins and/or clays from the individual grains of sand.

In one embodiment of the invention, metal cubes or spheres are added to one or more of the compartments so as to provide additional attrition between the sand grains themselves and with the cubes or balls so as to remove or snub off the burned bonding agents, such as clays and resins, from the sand particles themselves. The cubes or balls are retained within their respective individual compartments by virtue of the fact that they are diametrically sized so as to be slightly larger than the gated openings of the next succeeding divider panel. Thus, cubes or balls contained in each succeeding compartment would be progressively smaller so as to enhance the attrition process as the sand mass moves through the sand reclaimer drum.

The presence of the cubes or spheres enhances the action of the cylindrical sand reclaimer drum in (1) breaking up lumps of broken sand molds received through the intake openings provided in the forward elevated end wall of the drum (2) abradingly removing the burned bonding agents from the individual sand particles and (3) polishing, smoothing or rounding the sand grains as they pass therethrough.

It has been found that polished (i.e. more spherical and smoother) sand grains require lesser amounts of catalyst and resin on re-mix in chemically bonded sand mold operations. Even original "new" sand grains have fissures and other imperfections which literally soak up resin like a blotter, thus greatly increasing the costs of chemically bonded sand mold operations. Thus, the use of the rotary sand reclaimer and abrasion media (cube and/or spheres) not only clean the contaminated sand but rids the sand grains themselves of imperfections as a result of the polishing action involved. The end result is cleaned and polished sand which results in molds having higher tensile strength. The overall costs in producing such molds is not only reduced because less catalysts and resins are needed for mixing with the sand, but less new sand is required for mixing with reclaimed sand. Heretofore, it has been necessary to add new sand to the reclaimed sand so as to form a mixture having a ratio of approximately 60% new sand to 40% reclaimed sand. By use of this sand reclaimer invention, reclaimed sand of such high quality if produced so as to reduce the percentage of new sand required to the range of about 10% to 20% of the total mixture.

PRIOR ART

None of the known prior art devices show or otherwise anticipate a sand reclaimer which comprises a rotatable cylindrical drum for removing spent resin contaminants and refuse from foundry molding sand and the like wherein a plurality of divider panels are mounted on a central shaft so as to form a plurality of compartments within the cylindrical drum. The divider panels of this invention are provided with a plurality of openings along the circumferential edges thereof which have adjustable gates in association therewith so that the size of the openings can be selectively varied as desired. These openings are made progressively smaller in size so that the contaminated sand lumps are reduced in size as they progress from one compartment to the next succeeding compartment.

Examples of the known prior art are seen in the U.S. Pat. Nos. to Brown et al; 6,598, Wells; 1,897,156, Goldberg; 1,960,085, Cave; 1,992,288, Walle; 2,286,132 and Hurter; 2,664,204.

A need has therefore existed for a sand reclaimer for removing contaminants and refuse from foundry sand and the like and which is primarily adapted to remove burned bonding agents such as resins and/or clays from the individual grains of sand.

A still further need has existed for a sand reclaimer which not only removes impurities and other refuse from contaminated sand, but which provides an abrading action which acts to polish the individual grains of sand so that they acquire a more round and more smooth surface.

It is therefore an object of this invention to provide a rotatable sand reclaimer for removing spent resin contaminants and refuse from foundry molding sand.

Another object of this invention is to provide a sand reclaimer consisting of a cylindrical drum having a plurality of spaced apart divider panels which form a series of compartments within the cylindrical drum through which contaminated sand passes sequentially by virtue of the rotary action of the drum and the gated openings provided in the divider panels.

Yet another object of this invention is to provide a sand reclaimer having cyclone air removal suction means in association therewith so as to remove free bonding materials such as clay and porous burned resin particles which have been abraded from the sand particles as the contaminated sand mass passes through the sand reclaimer.

A still further object of this invention is to provide a sand reclaimer having a plurality of sand cleaning compartments through which contaminated sand sequentially passes and in which at least one or more of the compartments can be selectively provided with abrading cubes or spheres which enhance the abrasive action of the sand grains and lumps against each other and against the abrasion media.

Other objects of this invention will be apparent to those skilled in the art upon reading the present description, drawings and claims.

IN THE DRAWINGS

GENERAL DESCRIPTION

Figure 1:
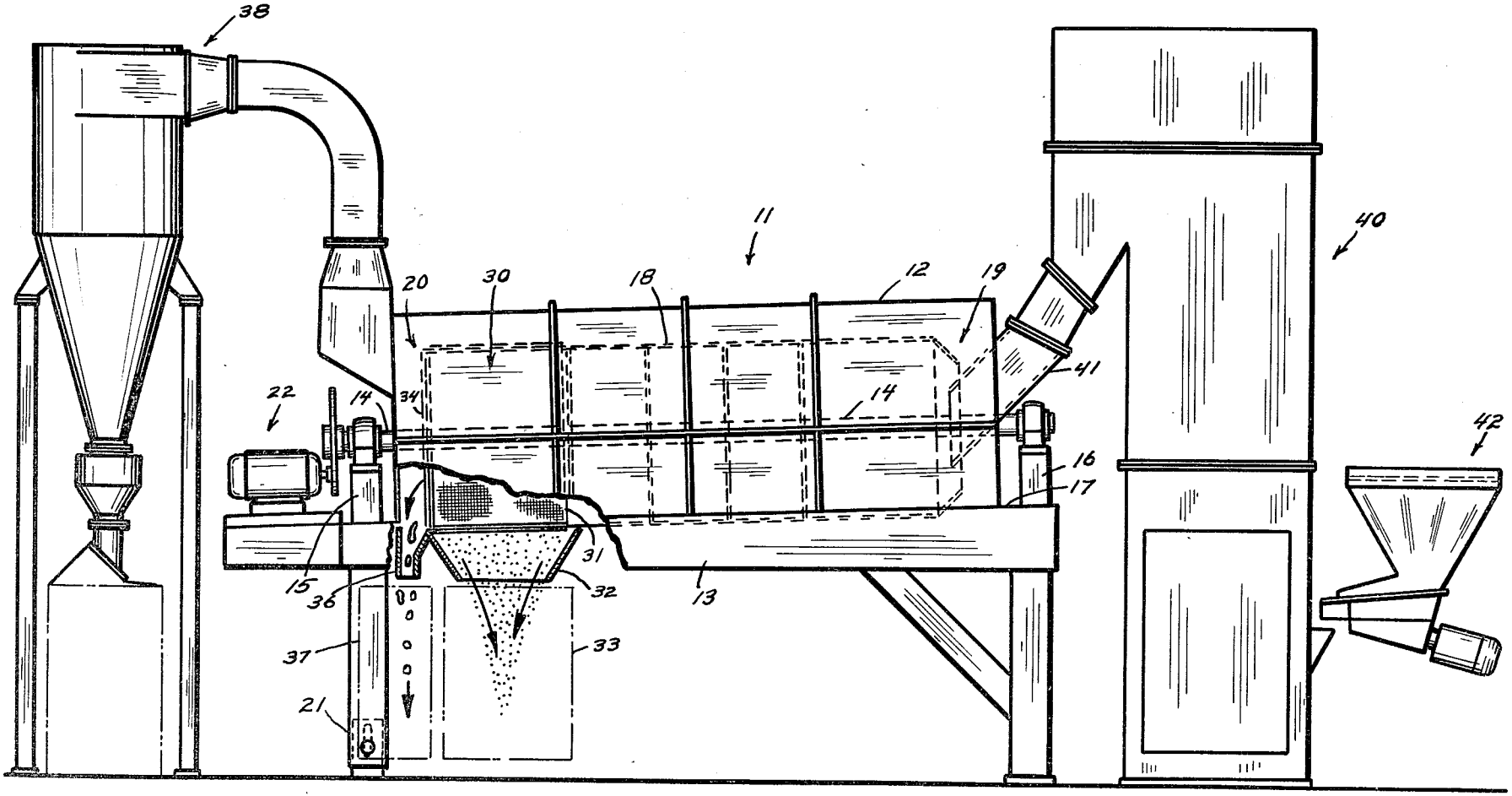
FIG. 1 is a side elevation view of the sand reclaimer showing the contaminated sand delivery means, the cylindrical rotary drum and drive means therefor, the cyclone air removal suction means, and the contaminant and cleaned sand discharge chutes.
Figure 2:
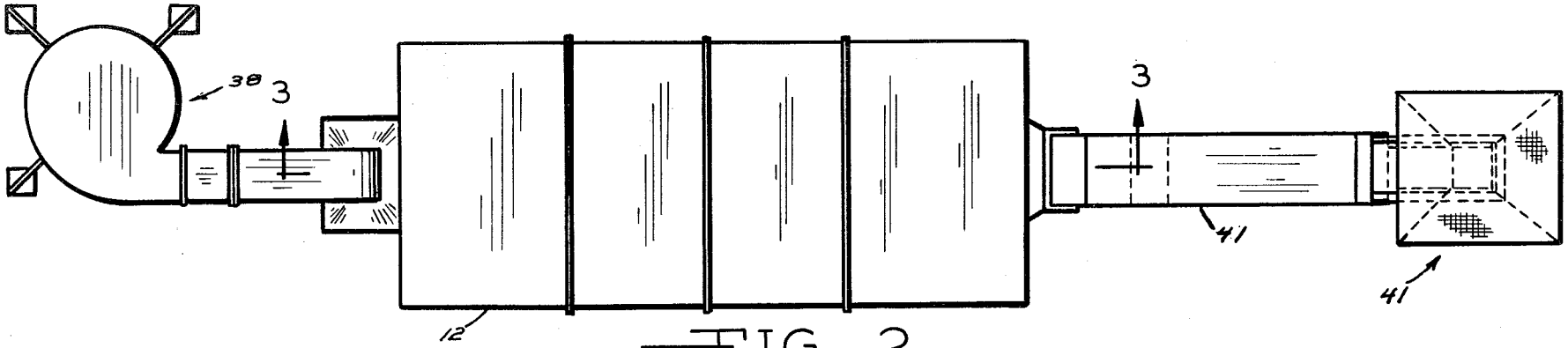
FIG. 2 is a top view thereof.

In general, a cylindrical sand reclaimer assembly is provided for removing spent resin contaminants and refuse particles from chemically bonded foundry molding sand and the like. The cylindrical sand reclaimer assembly is also uniquely adapted to remove free bonding materials such as clay and porous burned resin particles which have been abraded from the sand particles as the contaminated sand mass passes through the sand reclaimer assembly. A support frame is provided with an elongate housing thereon. An elongate main shaft is rotatably mounted in an inclined position through the housing. A cylindrical sand reclaimer drum is fixedly mounted on the main shaft and is rotatable therewith within the housing. As thus positioned, the cylindrical sand reclaimer drum has an elevated intake or loading end and a lowered discharge end. The sand reclaimer drum is provided with an end wall at the lowered discharge end thereof which has contaminant discharge openings therethrough. Contaminated sand intake delivery means are provided in association with the elevated intake end of the sand reclaimer drum so as to deliver contaminated sand comprised of used broken sand molds to the interior of the sand reclaimer drum. Motor drive means are provided in association with the main shaft so as to selectively rotate the main shaft and the sand reclaimer drum at any desired speed. The rotation of the inclinded drum causes the sand mass to advance through the drum at any desired predetermined rate while imparting a tumbling action thereto. A plurality of circular divider wall panels or discs are provided on the main shaft within the cylindrical drum so as to divide the cylindrical drum into a series of processing compartments through which the contaminated sand mass sequentially passes. Each of the divider panels are configured so as to extend radially from the main shaft into abutting circumferential contact with the inside wall of the sand reclaimer drum so as to provide the plurality of separate compartments therein. The divider wall panels, plates or discs can be mounted on the main shaft so as to selectively be axially adjustable in order to vary the size of the individual compartments as desired. A plurality of spaced-apart slot openings are provided along the circumferential edge of each of the divider wall panels so as to permit passage of the contaminated sand being cleaned from one compartment to the next succeeding compartment until the last compartment is reached at the lower discharge end of the cylindrical drum. The openings in each of the divider panels can be selectively sized so that the openings are made progressively smaller in each next adjacent lower divider panel within the inclined drum. These sized openings are adapted to progressively decrease the size of the lumps of contaminated sand passing through the processing compartments in the inclined sand reclaimer drum. Each opening can also be provided with a selectively adjustable gate so that the size of the openings in each divider panel can be selectively varied as desired. As shown in the drawings, the openings in the first divider panel or wall encountered after the intake end of the drum are the largest. Thereafter, the openings in each succeeding divider wall panel are made progressively smaller. In this way, the largest pieces of contaminants are trapped in the first compartment as the sand mass passes therethrough. Thereafter, each succeeding compartment traps and reduces progressively smaller pieces of contaminants of the moving sand mass. Although adjustable openings are provided in the divider wall panels, it is considered to be within the scope of the invention that fixed openings are provided in each panel with the openings made progressively smaller in each of the succeeding panels so that the same progressive removal or reduction of contaminants by size is achieved. The last or lowermost compartment at the discharge end of the drum is provided with one or more screen mesh openings in the circumferential wall of the sand reclaimer drum. The mesh screen openings are adapted to selectively screen sand therethrough while retaining oversize contaminants and refuse thereon. Thus, passable cleaned sand drops through the screen mesh openings into a cleaned sand discharge chute which delivers the cleaned sand to a hopper or take-off conveyor (not shown). Any oversize spent bonding contaminants or refuse remaining in the last compartment are expelled through segmented contaminant discharge openings in the discharge end wall of the drum and drop through a contaminant discharge chute into a discharge hopper or conveyor (not shown) for subsequent disposal. In one ebodiment of the invention, abrasion media, such as metal cubes, balls or spheres (not shown) are provided in one or more of the processing compartments so as to enhance the abrading action caused by the tumbling action of the sand mass brought about by the rotation of the drum. The metal abrasion media means (cubes and/or spheres) also help break the lumps of broken molds which are delivered into the intake end of the cylindrical drum by the contaminated sand intake chute. As previously stated, the tumbling action of the sand mass and the abrading action of the metal cubes and/or spheres abrade and remove the bonding material contaminants such as clay and burnt resin particles from the sand grains. Cyclone air removal suction means are provided in association with the cylindrical drum and its housing so as to remove these freed bonding contaminant particles from the sand mass.The cyclone air removal suction means are provided proximate to the lowered discharge end of the sand reclaimer drum and the screen mesh openings provided therein.

DESCRIPTION OF A PREFERRED EMBODIMENT

As shown in FIG. 1 the cylindrical sand reclaimer assembly 11 consists of a housing 12 mounted upon a support frame 13. A main shaft 14 is rotatably mounted upon support trunnions 15 and 16 respectively, provided on the inclined upper surface 17 of the support frame 13. A cylindrical sand reclaimer drum 18 is fixedly mounted on the main shaft 14 and is rotatable therewith within the housing 12. The main shaft 14 and the cylindrical drum 18 are mounted so that the longitudinal axis thereof is slightly inclined from the horizontal. Thus positioned, the drum 18 has an elevated intake end 19 and a lower discharge end 20. The degree of inclination of the main shaft 14 and drum 18 can be selectively varied by use of the adjustable leg 21 of the support frame 13. A motor drive assembly 22 is connected to the main shaft 14 so as to rotatably drive the main shaft 14 and cylindrical drum at any desired speed. The motor drive assembly 22 can be of the chain and sprocket, gear or belt driven type and has the ability to drive the main shaft 14 at any desired selectively adjustable speeds.

Figure 3:
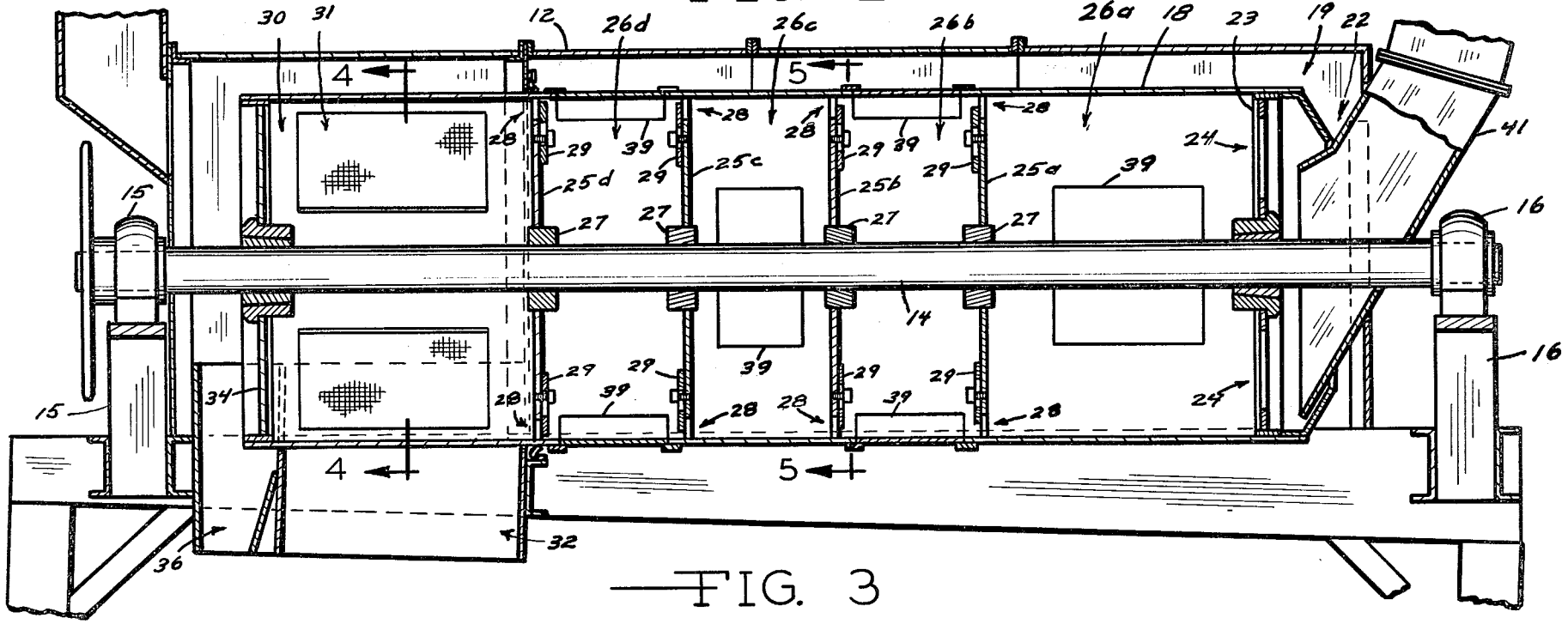
FIG. 3 is a cross-sectional view of the sand reclaimer drum taken on line 3—3 of FIG. 2 and showing the divider panels mounted therein so as to provide a plurality of compartments through which the contaminated sand passes.

As shown in FIG. 3, the cylindrical drum 18 has an elongate body portion with an intake opening 22 in the elevated forward end 19 thereof. A circular forward end wall plate 23 is fixedly attached to the main shaft within the drum 18 and proximate to the intake opening 22.

The forward end wall plate 23 is provided with a plurality of radially extending openings 24 through which contaminated sand in the form of lumps of broken used molds pass into the interior of the cylindrical drum 18.

A plurality of circular spaced-apart divider wall panels **25*a*, 25*b*, 25*c* and 25*d*, respectively are fixedly attached to the main shaft so as to form a plurality of compartments 26*a*, 26*b*, 26*c* and 26*d* within the drum 18. The outer circumferential edge of each divider wall panel is in abutting but free engagement with the inside wall surface of the cylindrical drum 18. In one embodiment of the invention, each of the divider wall panels 25 are attached to the main shaft 14 by use of split collar means 27** which permit selective axial adjustment of the divider wall panels so as to vary the size of the compartments formed thereby.

Figure 5:
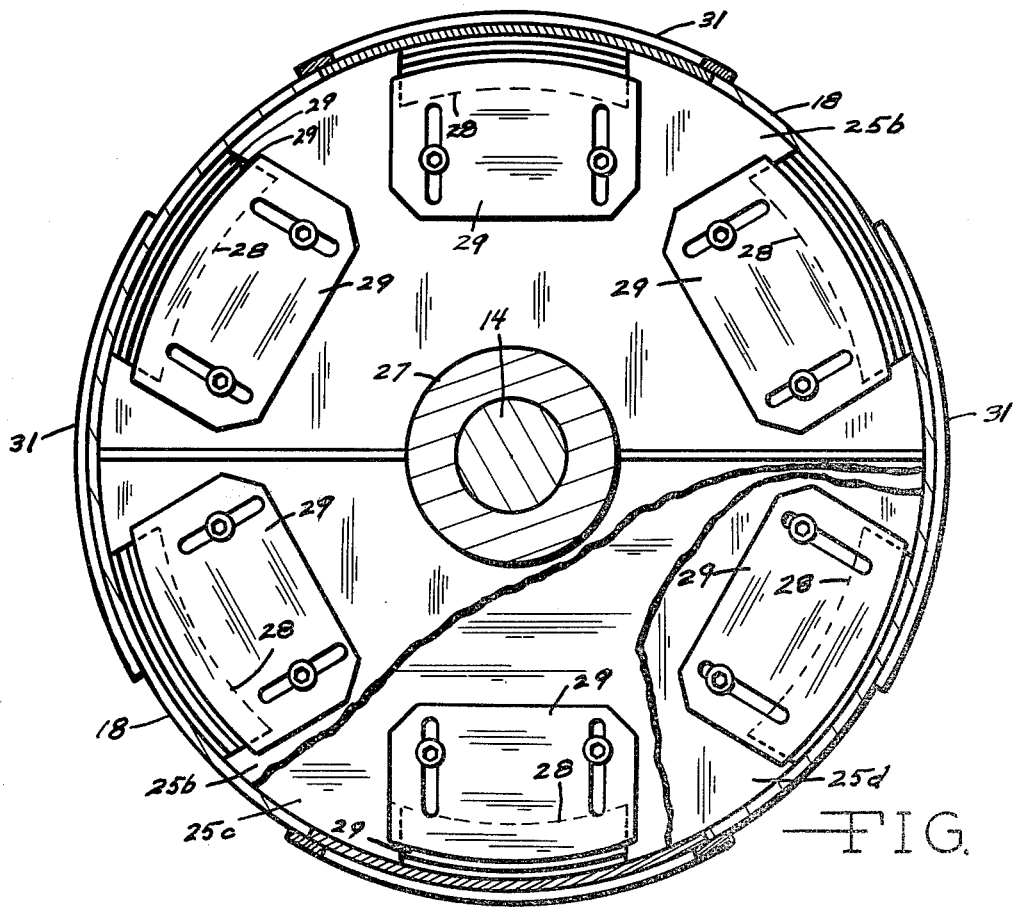
FIG. 5 is a cross-sectional view of the rotary drum taken on line 5—5 of FIG. 3 showing one of the divider panels with gated openings along the circumferential edge thereof and broken away to show the next succeeding panels with the succeedingly smaller gated openings provided therein.

As shown in FIGS. 3 and 5, a plurality of openings 28 are provided around the circumferential edge of each of the divider panels 25. Each of the openings 28 are provided with adjustable closure gates 29 so that the size of the openings can be selectively varied as desired. As shown in FIG. 5, the size of the openings 28 in each of the respective panels progressively diminish in size beginning with divider panel **25*a* and moving toward the discharge end 20 of the drum 18. Thus, the openings 28 in panel 25*b* are slightly smaller than the openings in panel 25*a*, the openings 28 in panel 25*c* are smaller than the openings in panel 25*b*, and the openings in panel 25*d* are smaller than the openings in panel 25*c*. Thus, as the contaminated sand lumps progress through each separator compartment 26 toward the discharge end of the drum 18, the larger size lumps are retained in the first compartment due to the sized openings of panel 25*a*. The smaller sized openings in the succeeding panels 25*b*, 25*c* and 25*d* accordingly allow passage of smaller lumps until the final compartment 30** is reached.

Screened mesh openings 31 are provided in the circumferential wall of the cylindrical drum 18 located within the final compartment 30 at the lower end of the drum 18. A cleaned sand discharge chute 32 is located beneath the screened mesh panel openings 31 to receive the cleaned sand dropping therethrough and direct it into a hopper 33 or take-off conveyor (not shown).

Figure 4:
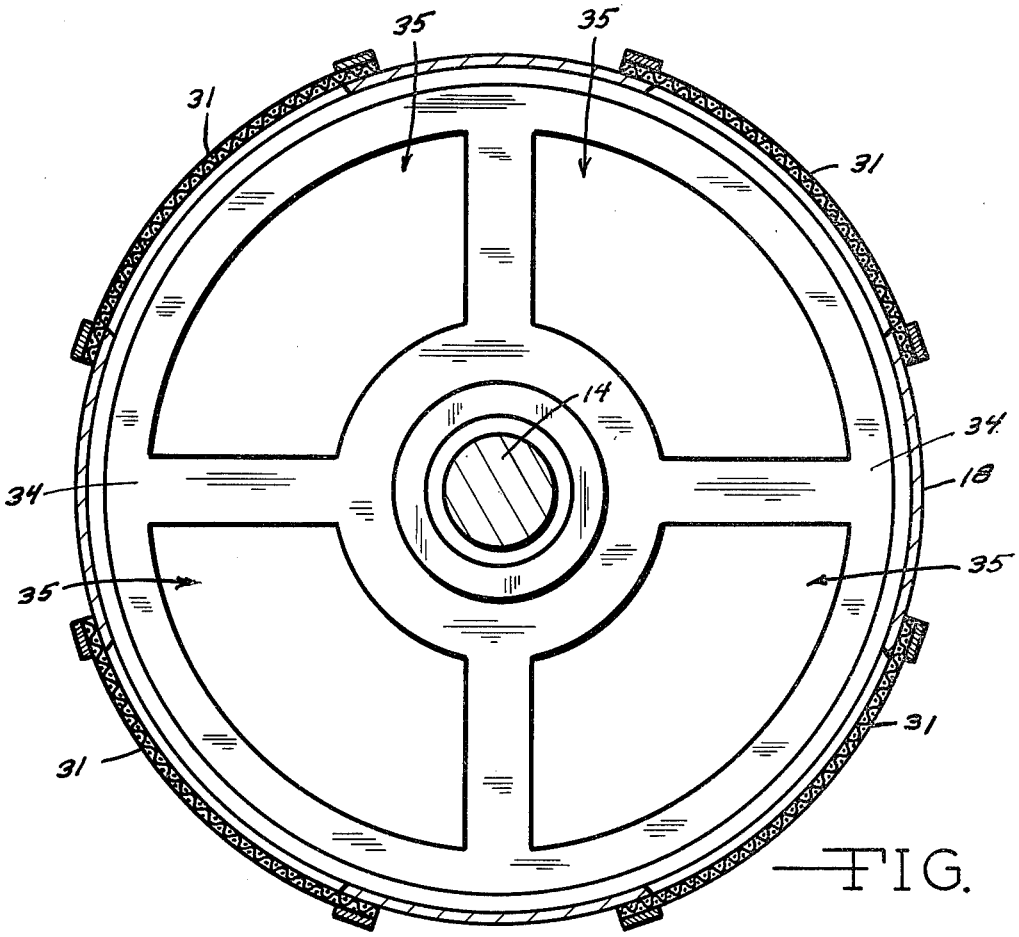
FIG. 4 is a cross-sectional view of the sand reclaimer drum taken on line 4—4 of FIG. 3 showing the lower end wall with segmented contaminant discharge openings provided therein.

A rear contaminant discharge end panel 34 is provided at the lower end 20 of the cylindrical drum 18. As shown in FIG. 4, radially extending openings 35 are provided in the end panel 34 so as to permit oversize contaminants to be discharged therethrough into the contaminant discharge chute 36 which directs the contaminants into a suitable hopper 37 or take-off conveyor (not shown).

Steel cubes or spheres (not shown) can be added to one or more of the compartments 26 so as to enhance the abrading contact between the sand grains and walls of the rotary drum and divider panels as the sand mass undergoes a tumbling action brought about by the rotation of the cylindrical drum 18. The fact that the drum is inclined causes the tumbling sand mass to advance through the succeeding compartments through the sized openings 28 in the divider panels 25.

A cyclone air removal suction means assembly 38 is connected to the dust enclosure housing 12 and is adapted to cause air to flow upwardly through the screen mesh openings 31, the cleaned sand dropping therethrough, and the open ends of the cylindrical drum 18 so as to remove minute freed particles of impurities which have been abraded off the sand grains by action of the rotary sand reclaimer. These minute particles generally consist of bonding agents such as clay and burned resins originally mixed into the molding sand prior to the making of the molds. This excess burned out resin must be removed before the reclaimed sand is used again or the resultant molds would not have castable characteristics.

As shown in FIG. 3, inspection panels 39 are provided in the wall of the cylindrical drum 18 so as to permit selective addition or removal of the abrasion media (cubes and/or spheres) in the compartments 26.

A contaminated sand delivery bucket elevator assembly 40 is provided with an intake delivery chute 41 which is configured to extend into the intake opening 22 provided in elevated forward end portion 19 of the cylindrical drum 18 so as to deliver the contaminated sand in the form of broken sand mold lumps into the interior of the cylindrical drum for cleaning. A hopper and loader assembly 42 comprising a vibratory feeder is utilized to load contaminated sand lumps into the delivery elevator assembly 40.

OPERATION

In operation, the contaminated sand mass comprised of lumps of used broken sand molds is delivered by the intake delivery chute 41 through opening 22 into the interior of the rotating cylindrical sand reclaimer drum 18. The contaminated sand mass advances along the inside of the inclined drum 18 due to the rotation of the drum. The sand mass passes through the openings 24 provided in the forward end wall 23 into compartment **26*a*. The tumbling action imparted by the rotating drum tends to break down the lumps of broken molds until the first divider panel 25*a* is encountered. The sand mass passes through openings 28 provided in the divider panel 25*a*. Any contaminant particles or lumps which cannot pass through the openings 28 in panel 25*a* are retained in compartment 26*a* for subsequent removal through the contaminant removal panels 39 provided in the wall of the cylindrical drum 18. The sand mass continues to move sequentially through compartments 26*b*, 26*c* and 26*d*, respectively, with contaminant particles being removed from the sand in these compartments. When the sand mass reaches compartment 30, the passable sand drops through the screen mesh openings 31 into the cleaned sand discharge chute 32 where it is directed into a hopper 33 or a take-off conveyor (not shown). Any oversize contaminants 43 retained in compartment 30 pass through the contaminant discharge openings 35 provided in the end wall panel 34 and drop into the contaminant discharge chute 36 for disposal. As previously stated, the suction air removal means 38 draws air upwardly through the screen mesh panel openings 31 and generally through the cylindrical drum 18 and housing 12** so as to remove small particles of freed contaminants from the sand mass, such as free particles of bonding materials of clay and burned resin which have been abraded from the sand grains by the abrading action caused by the tumbling action of the sand mass and, in one embodiment of the invention, by action of metal cubes and/or spheres within one or more of the compartments.

It is thus seen that this invention provides a cylindrical sand reclaimer assembly which not only removes metallic shot contaminants and refuse from contaminated sand but effectively removes therefrom free minute particles of undesirable bonding materials such as clay and burnt resin materials and smooths the sand grains themselves. The end result is reclaimed sand which has a higher degree of cleanliness than has hitherto been possible and which requires a lower percentage of "new" sand when mixed for re-use.

From this presentation of an operative embodiment of my invention, improvements, modifications and substitutions will become apparent to those skilled in the art. Such improvements, modifications and substitutions are intended to be included within the spirit of the invention limited only by the scope of the hereinafter appended claims.

I claim:

1. A cylindrical sand reclaimer assembly for removing spent bonding contaminants and refuse from chemically bonded foundry molding sand and the like comprising:

a support frame, said support frame provided with an elongate housing thereon;

an elongate main shaft rotatably provided in an inclined position through said housing;

a cylindrical sand reclaimer drum fixedly mounted on said main shaft and being rotatable therewith within said housing, said cylindrical sand reclaimer drum maintained in an inclined position so as to have an elevated loading end and lowered discharge end, said cylindrical sand reclaimer drum provided with an end wall at said lowered discharge end having contaminant discharge openings therethrough;

a plurality of spaced-apart divider panels provided on said shaft within said sand reclaimer drum, each of said divider panels extending radially from said shaft into abutting circumferential contact with the inside wall of said sand reclaimer drum so as to provide a plurality of separate compartments within said sand reclaimer drum, each of said divider panels provided with spaced-apart openings along the circumferential edges thereof so as to provide communication between said compartments;

at least one screen mesh opening provided in the circumferential wall of said reclaimer drum within said compartment which is positioned at the lowered discharge end of said reclaimer drum, said screen mesh opening adapted to selectively screen and particles therethrough while retaining oversize contaminants and refuse thereon;

a cleaned sand discharge chute provided beneath said screen opening so as to receive cleaned sand which has passed therethrough;

a spent bonding contaminant and refuse discharge chute provided beneath said discharge end of said cylindrical sand reclaimer drum so as to receive spent bonding cotaminants and refuse therefrom;

drive means provided in association with said main shaft, said drive means adapted to rotate said main shaft and said cylindrical sand reclaimer drum at a rate sufficient to advance a sand mass along the interior of said sand reclaimer drum through each of said compartments by passing through said openings in said divider panels so that cleaned sand particles drop through said screen mesh opening and oversize spent bonding contaminants and refuse are expelled through said contaminant discharge openings in said end wall; and cyclone air removal suction means provided in association with said housing proximate to said lowered discharge end of said sand reclaimer drum, said cyclone air removal suction means adapted to remove freed resin particles from the sand mass passing through said sand reclaimer drum.

2. In the cylindrical sand reclaimer assembly of claim 1 wherein said openings in each of said divider panels are selectively sized so that said openings are progressively smaller in each next adjacent lower divider panel within said inclined drum, said openings adapted to progressively decrease the size of clumps of contaminated sand passing through said inclined sand reclaimer drum.

3. In the cylindrical sand reclaimer assembly of claim 1 wherein said openings in each of said divider panels are provided with selectively adjustable gates so that the size of said openings can be selectively varied.

4. In the cylindrical sand reclaimer assembly of claim 1 wherein said divider panels are selectively axially adjustable along said shaft so as to vary the size of said compartments.

5. In the cylindrical sand reclaimer assembly of claim 1 wherein abrasion media means are selectively provided within at least one of said compartments, said abrasion media means adapted to enhance attrition between contaminated sand particles and said abrasion media means so as to remove burned bonding agents from the contaminated sand particles passing through said sand reclaimer drum.

* * * * *